US006202958B1

(12) United States Patent
Dommer et al.

(10) Patent No.: US 6,202,958 B1
(45) Date of Patent: Mar. 20, 2001

(54) MOUNTING ARRANGEMENT FOR THE PIVOTALLY OPENABLE RUDDER BLADES OF A GUIDED MISSILE

(75) Inventors: Josef Dommer, Nuremburg; Werner Schroppel, Wendelstein; Martin Staudenmeir, Neunkirchen, all of (DE)

(73) Assignee: Diehl Stiftung & Co., Nürnberg (DE)

( * ) Notice: Subject to any disclaimer, the term of this patent is extended or adjusted under 35 U.S.C. 154(b) by 0 days.

(21) Appl. No.: 09/333,605

(22) Filed: Jun. 15, 1999

(30) Foreign Application Priority Data

Jun. 19, 1998 (DE) ..... 198 27 277

(51) Int. Cl.[7] ..... F42B 10/14
(52) U.S. Cl. ..... 244/3.28; 244/46; 244/49
(58) Field of Search ..... 244/3.24–3.3, 244/46, 49

(56) References Cited

U.S. PATENT DOCUMENTS 4,660,786 * 4/1987 Brieseck et al. ..... 244/3.24
4,728,058 * 3/1988 Brieseck et al. ..... 244/3.28
5,211,357 * 5/1993 Leidenberger ..... 244/3.28

FOREIGN PATENT DOCUMENTS

2410255 C2 10/1974 (DE) .
3441534 A1 5/1986 (DE) .

* cited by examiner

*Primary Examiner*—Harold J. Tudor
(74) *Attorney, Agent, or Firm*—Scully, Scott, Murphy & Presser

(57) ABSTRACT

To maintain control accuracy for the pivotable rudder blades (14), which lie in a combustion chamber, of a guided projectile (12) which can be fired by means of propellent charge, there is provide a mounting arrangement in which the trunnions (20) of the rudder blade holders (16) of the diametrally mutually opposite rudder blades (14) are torsionally stiffly rigidly connected through an associated coupling element (32) which is limitedly resilient in the radial direction of the guided projectile (12).

5 Claims, 4 Drawing Sheets

MOUNTING ARRANGEMENT FOR THE PIVOTALLY OPENABLE RUDDER BLADES OF A GUIDED MISSILE

BACKGROUND OF THE INVENTION

1. Field of the Invention

The invention concerns a mounting arrangement for the pivotally openable rudder blades, which cross each other in pairs, of a guided missile, particularly a projectile which can be fired through the intermediary of a propellant charge gas pressure.

2. Discussion of the Prior Art

A mounting arrangement of that kind is known from DE 34 41 534 A1. In that known mounting arrangement, an elastically upsettable sealing ring is provided between the one annular shoulder on the respective shaft trunnion, and the associated second annular shoulder which is provided on the tail structure of the missile. A sealing effect and a return function are implemented by means of that sealing ring when the missile is launched by means of the propellent charge. Sealing rings of that kind consisting of elastically upsettable material however are only suitable for certain gas pressures which are limited in an upward direction. In addition, elastically upsettable sealing rings of that kind suffer from material ageing which has an effect on the properties thereof in terms of stock-keeping and durability.

Furthermore, with that known mounting arrangement of the above-described kind, it is necessary for the shaft trunnion of the corresponding rudder blade holder to be provided with an inclinedly extending opening into which an associated screwthreaded pin projects in order to provide for axial adjustment in force-locking relationship. Furthermore each shaft trunnion is provided with the coupling element by means of a key-and-spline connection in order to afford definedly limited radial mobility of the respective rudder blade. All those components however involve production tolerances which cannot be eliminated, and that has a corresponding effect on the angular positioning of each rudder blade. In addition the manufacture of that known mounting arrangement involves corresponding costs. Furthermore the elastically upsettable sealing rings result in the creation between the tail structure of the missile and the rudder blade holders for the rudder blades of a friction which cannot be disregarded and which has an effect on displacement of the rudder blades.

SUMMARY OF THE INVENTION

In consideration of those factors the object of the present invention is to provide a mounting arrangement of the kind set forth in the opening part of this specification, in which dimensional tolerances between the components or individual parts of the mounting arrangement do not have any influence on the angular position of the rudder blades, which is suitable for comparatively high gas pressures of the missile which can be fired by means of propellent charge gas pressure, which enjoys excellent storability and in which the friction aspects are substantially reduced.

In the case of the mounting arrangement according to the invention, the spacing between the first annular shoulder provided on the rudder blade holder and the second annular shoulder provided on the tail structure of the missile is slightly greater than the thickness of the ring element which is disposed therebetween and which comprises an inelastic material, preferably metal, so that between the ring element and the first and second annular shoulders there is an axial tolerance play considered in relation to the associated trunnions. That provides for the attainment of a comparatively low level or precisely predictable degree of friction. The respective ring element of inelastic material or metal affords the advantage that the mounting arrangement according to the invention is not only suitable for higher gas pressures but that in addition material ageing is also prevented and thus storability over a longer period of time is achieved.

The fact that, in the mounting arrangement according to the invention, the trunnions of the respective pair of trunnions are rigidly connected to the associated coupling element which is of a limitedly resilient nature in the radial direction of the projectile affords the advantage that manufacturing tolerances between the corresponding parts of the mounting arrangement do not have any influence on the angular positioning of the rudder blades, that is to say angular positioning of the rudder blades is possible in a highly precise fashion in a simple manner.

The angular position of the rudder blades or the angular position of the rudder blade holders for the rudder blades in relation to each other is determined simply and solely by the degree of connecting accuracy between the respective rudder blade holder and the associated trunnion. As in accordance with the invention the trunnions of the respective pair thereof are rigidly connected to the associated coupling element, the degree of manufacturing accuracy of those parts advantageously has no influence on the angular position of the rudder blade holders or the respective pair of trunnions. That rigid connection can be implemented for example by the respective trunnion being pinned, glued, welded or clamped to the associated coupling element. The respective coupling element desirably has a pair of mutually spaced mounting end portions for the associated trunnions and a connecting central portion which radially elastically resiliently connects the two mounting end portions. The connecting central portion can be of a meander-shaped, arcuate, zig-zag shaped or any other configuration, the only consideration of importance being that it is limitedly elastically resiliently yielding in the racial direction of the projectile.

The mounting end portions can be for example of a sleeve-shaped or socket-shaped configuration or a journal or trunnion configuration. The shaft trunnions of the rudder blade holders are of a configuration which is adapted thereto. So that the connecting central portions of the two mutually crossing coupling elements do not impair each other in respect of their mobility, the connecting central portion of at least one of the two coupling elements can be disposed eccentrically in relation to the associated mounting end portions.

It will be appreciated that it is also possible for the connecting central portions of the two coupling elements to be disposed eccentrically in relation to the associated mounting end portions.

To provide for the defined angular setting as desired of the rudder blade holders or the pairs of rudder blades, the respective coupling element can be provided at one of its two mounting end portions with a control projection which extends radially away therefrom. The respective control projection is engaged by an actuating or drive element of a control drive of the guided missile or projectile.

BRIEF DESCRIPTION OF THE DRAWINGS

Further details, features and advantages will be apparent from the description hereinafter of an embodiment, illustrated by way of example in the drawing, of the mounting arrangement according to the invention for the pivotally openable rudder blades, which cross each other in pairs, of a guided missile, which is in particular a projectile which can be fired by means of propellent charge gas pressure, and essential details of the mounting arrangement. In the drawing.

DETAILED DESCRIPTION OF PREFERRED EMBODIMENTS

Figure 1:
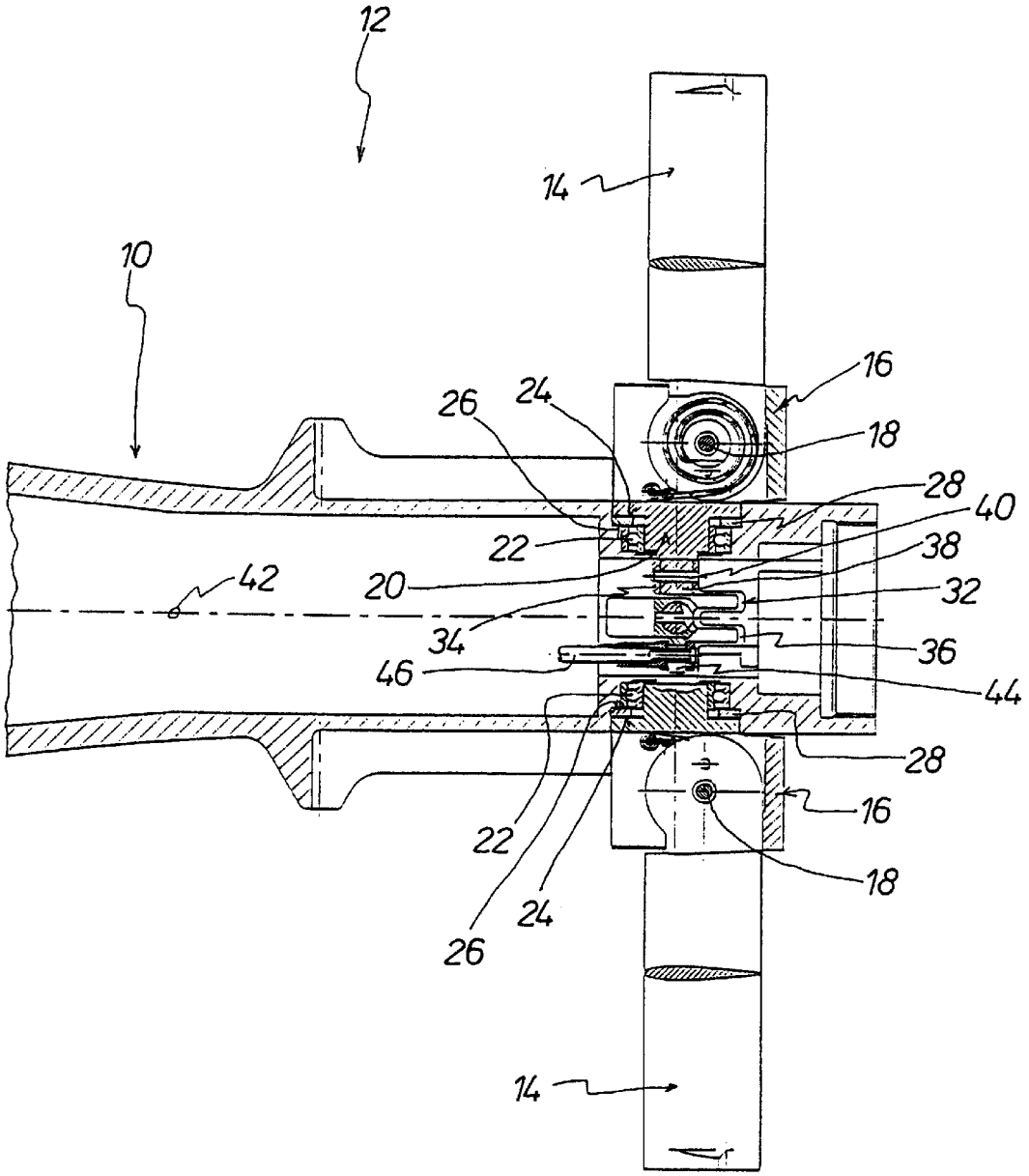
FIG. 1 is a view in longitudinal section of the tail portion of a projectile with rudder blades which cross each other in pairs and which are in the pivoted-open condition and which are provided on associated rudder blade holders in such a way that they can be pivoted open.
Figure 2:
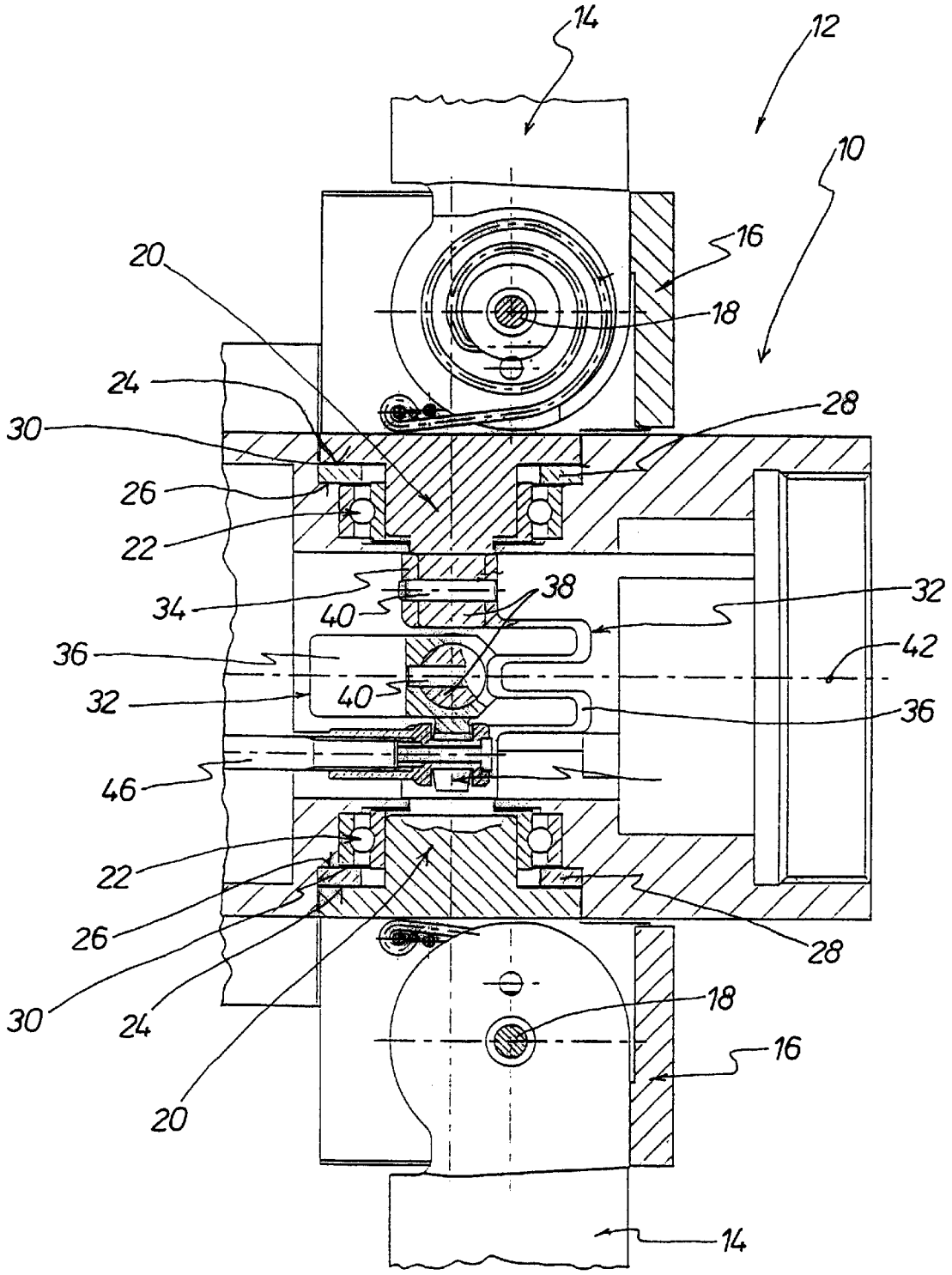
FIG. 2 is a view on an enlarged scale of a detail from FIG. 1 for further illustrating the rudder blade holders which are associated in pairs, with the associated coupling element of a limitedly resilient nature.

FIGS. 1 and 2 show a tail portion 10 of a missile 12 which has over-calibre rudder blades 14 which are shown in their pivoted-open steering position. Each rudder blade 14 is mounted on an associated rudder blade holder 16 pivotably about a common pivot axis 18.

Each rudder blade holder 16 has a shaft trunnion 20 which extends into the tail structure 10 of the missile 12. The respective trunnion 20 is mounted rotatably in the tail structure 10 by means of a bearing 22 and limitedly movably in the radial direction of the missile 12. The trunnion 20 is designed with a first annular shoulder 24 and the tail structure 10 is designed adjoining the bearing 22 with a second annular shoulder 26, with a ring element 28 being arranged between the annular shoulders. The ring element 28 comprises an inelastic material, desirably a metal or a metal alloy.

The spacing between the first and second annular shoulders 24 and 26 is slightly greater than the thickness of the ring element 28 arranged therebetween so that there is an axial tolerance play 30 between the ring element 28 and the first and second annular shoulders 24 and 26 respectively (see in particular FIG. 2).

Figure 3A:
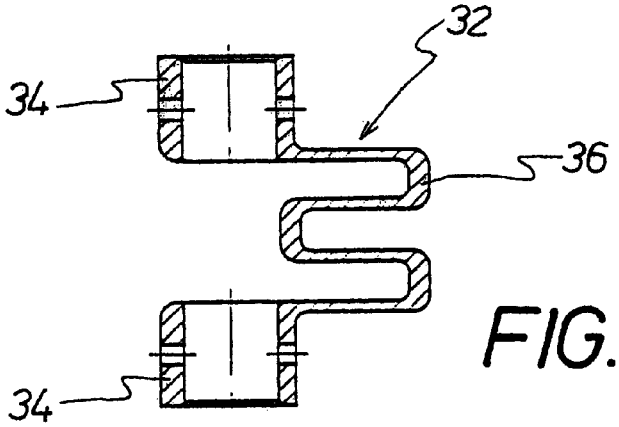
FIGS. 3A to 3F show various configurations of the limitedly resilient coupling element for associated rudder blade holders as shown in FIGS. 1 and 2.
Figure 3B:
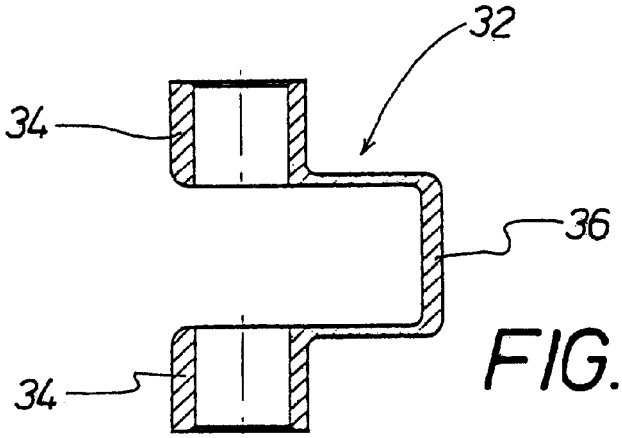
Figure 3E:
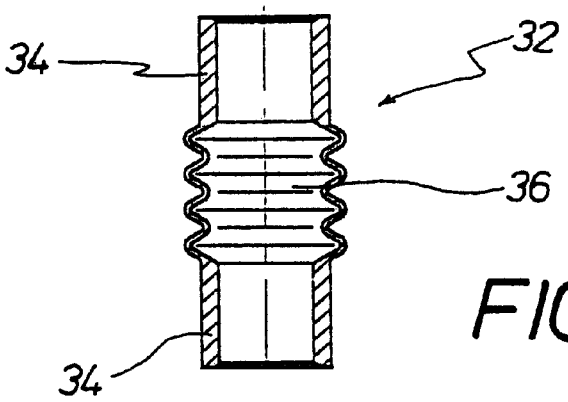
Figure 3C:
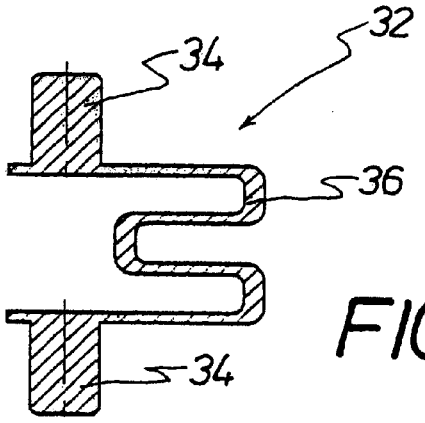
Figure 3D:
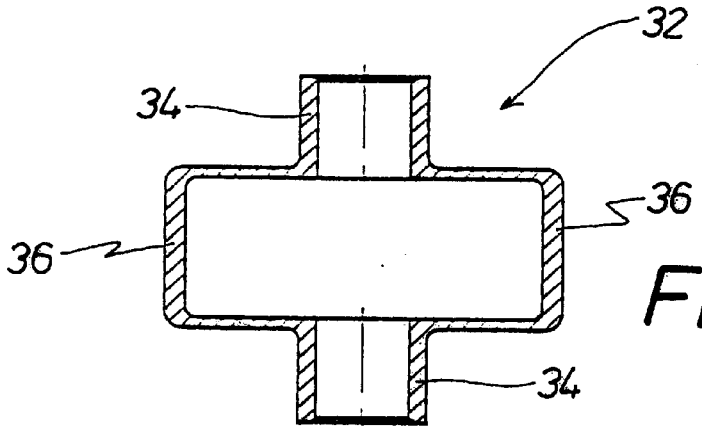
Figure 3F:
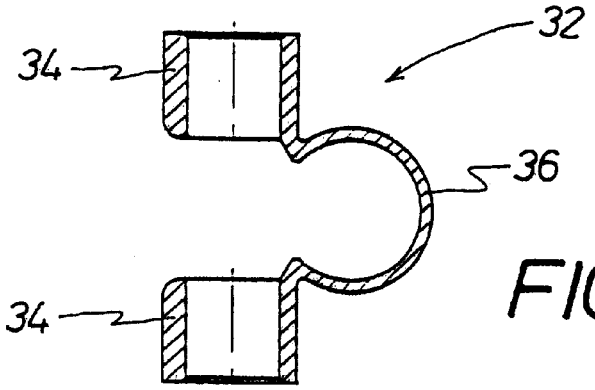

The trunnions 20 of the rudder blade holders 10 of the respective pair of diametrally mutually opposite rudder blades 14 are non-rotatably connected together by means of a coupling element 32. For that purpose the corresponding coupling element 32 has a pair of spaced-apart mounting end portions 34 and a connecting central portion 36 which elastically resiliently connects the two mounting end portions 34 together. In the embodiment shown in FIGS. 1 and 2 the respective connecting central portion 36 is of a meander-like configuration (see also FIG. 3A or FIG. 3B). In comparison FIG. 3C shows a connecting central portion 36 which extends in a simple angular configuration in eccentric relationship away from the mounting portions 34. FIG. 3D shows a configuration of a coupling element 32 in which two connecting central portions 36 which are of an outwardly bulged angular configuration are disposed in opposite relationship. FIG. 33 shows a configuration in which the elastically resilient connecting central portion 36 is axially aligned with the mounting end portions 34, the connecting central portion 36 being of a concertina or bellows configuration. Such a coupling element 32 as shown in FIG. 3E can be combined for example with a coupling element 32 as shown in FIGS. 3A to 3D or with a coupling element as is illustrated in FIG. 3F which has an arcuately bulged-out, elastically resilient connecting central portion 36 which extends eccentrically away from the two mounting end portions 34.

The trunnions 20 of the respective pair thereof are rigidly connected to the associated coupling element 32. For that purpose the two mounting end portions 34 of the respective coupling element 32 are for example of a sleeve-shaped or socket-shaped configuration in order to receive the corresponding end portion 38 of the respective trunnion 20. The rigid connection between the mounting end portions 34 and the trunnions 20 is effected for example by means of a pin 40. That rigid connection can also be implemented by glueing, welding or clamping.

To provide for the desired setting of the rudder blades 14 in relation to the longitudinal axis 42 of the missile 12, a control projection 44 projects radially away from the respective coupling element 32 at one of its two mounting end portions 34 (see FIG. 1 and in particular FIG. 2). The respective control projection 44 is for example of a forked configuration in order to be able to mount thereto a drive or actuating element 46 of a rudder blade control drive (not shown).

What is claimed is:

1. A mounting arrangement for pivotally movable pairs of rudder blades (14) of a guided missile (12) which is fired through the intermediary of a propellent charge gas pressure, wherein each said rudder blade (14) is mounted pivotally openable to a rudder blade holder (16) having a trunnion (20) with a first annular shoulder (24), the trunnion (20) extending radially into a tail structure (10) of the projectile (12), the tail structure (10) is formed with a second annular shoulder (26), a ring element (28) constituted of an inelastic material is arranged between the first and second annular shoulders (24, 26) and the trunnion (20) of each of the rudder blade holders (16) of the pair of rudder blades are axially aligned and the trunnions (20) operatively associated therewith are non-rotatably interconnected by a coupling element (32), wherein a spacing between the first and second annular shoulders (24, 26) of each said trunnion (20) and the tail structure (10) is slightly greater than the thickness of the ring element (28) therebetween so that there is an axial tolerance play (30) between the ring element (28) and the first and second annular shoulders (24, 26), the minions (20) of the respective pair of trunnions are rigidly connected to the coupling element (32), and wherein the coupling element (32) is resilient in the radial direction of the projectile (12).

2. A mounting arrangement according to claim 1, characterized in that each said trunnion (20) is pinned, glued, welded or clamped to the coupling element (32).

3. A mounting arrangement according to claim 1, characterized in that said coupling element (32) has a pair of spaced-apart mounting end portions (34) each connected to respectively one of said trunnions (20), and a connecting central portion (36) which elastically resiliently connects the two mounting end portions (34) together.

4. A mounting arrangement according to claim 3, characterized in that the connecting central portion (36) of said coupling element (32) of two coupling elements (32) for said mounting arrangement is provided eccentrically in relation to the mounting end portions (34) thereof.

5. A mounting arrangement according to claim 3, characterized in that the coupling element (32) has at one of the mounting end portion (34) a radially outwardly extending control projection (44).

* * * * *

UNITED STATES PATENT AND TRADEMARK OFFICE

CERTIFICATE OF CORRECTION

PATENT NO. : 6,202,958 B1
DATED : March 20, 2001
INVENTOR(S) : J. Dommer et al.

It is certified that error appears in the above-identified patent and that said Letters Patent is hereby corrected as shown below:

Title page,
Item [57], ABSTRACT, "provide" should read -- provided --

Column 3,
Line 44, "Holders 10" should read -- Holders 16 --

Column 4,
Lines 35 and 40, "Trunnion" should read -- Trunnions --
Line 44, "Minions" should read -- Trunnions --

Signed and Sealed this

Fifteenth Day of October, 2002

*Attest:*

*Attesting Officer*

JAMES E. ROGAN
*Director of the United States Patent and Trademark Office*